US006615567B2

(12) United States Patent
Kuhn et al.

(10) Patent No.: US 6,615,567 B2
(45) Date of Patent: Sep. 9, 2003

(54) VERTICAL TUBULAR BAGGING MACHINE

(75) Inventors: Roland Kuhn, Reiskirchen (DE); Gerhard Kuss, Wetzlar (DE); Rene Ohrisch, Pohlheim (DE); Walter Baur, Gruendau (DE)

(73) Assignee: Rovema Verpackungsmaschinen GmbH, Fernwald (DE)

( * ) Notice: Subject to any disclaimer, the term of this patent is extended or adjusted under 35 U.S.C. 154(b) by 0 days.

(21) Appl. No.: 09/827,709

(22) Filed: Apr. 6, 2001

(65) Prior Publication Data

US 2002/0020152 A1 Feb. 21, 2002

(30) Foreign Application Priority Data

Apr. 7, 2000 (DE) ..... 100 17 479

(51) Int. Cl.[7] ..... B65B 9/06
(52) U.S. Cl. ..... 53/551
(58) Field of Search ..... 53/550–552

(56) References Cited

U.S. PATENT DOCUMENTS

| | | | | | |
|---|---|---|---|---|---|
| 2,899,875 | A | * | 8/1959 | Leasure | 53/551 |
| 3,785,112 | A | * | 1/1974 | Leasure et al. | 53/551 |
| 4,747,703 | A | * | 5/1988 | Cazes | 383/119 |
| 5,862,652 | A | * | 1/1999 | Schoeler | 53/551 |

FOREIGN PATENT DOCUMENTS

| | | | | | |
|---|---|---|---|---|---|
| EP | 0627355 | A1 | * | 12/1994 | B65B/9/20 |
| EP | 0708025 | A1 | * | 4/1996 | B65B/9/20 |
| WO | WO 99/38677 | | * | 8/1999 | B65B/9/20 |

* cited by examiner

*Primary Examiner*—Stephen F. Gerrity
(74) *Attorney, Agent, or Firm*—Flynn, Thiel, Boutell & Tanis, P.C.

(57) ABSTRACT

Bags with welded edges are created by a vertical tubular bagging machine. The bags are flat on top and are relatively wide at the bottom. Only one edge-welding device to create a top seam is provided on one side of the fill pipe. Two edge-welding devices on the opposite side of the fill pipe are used to create two bottom seams stabilizing the bag.

8 Claims, 3 Drawing Sheets

VERTICAL TUBULAR BAGGING MACHINE

FIELD OF THE INVENTION

The invention relates to a vertical tubular bagging machine comprising a strip of foil, a storage roller, guide rollers to guide the flat strip of foil to a forming shoulder, a foil-removing means to transport the strip of foil, a vertically aligned fill pipe to receive the strip of foil which has been reshaped into a foil tube, jaws of a cross-welding device to create cross-seams, a separating device to cut the foil tube, and plural flat expanding elements connected to the fill pipe and projecting away from the fill pipe, and an edge-welding device per expanding element is provided in foil-transport direction arranged downstream of the expanding elements, each edge-welding device being directed against the tube edge deflected by each expanding element. The invention relates furthermore to a bag created with such a tubular bagging machine.

BACKGROUND OF THE INVENTION

Such a known tubular bagging machine is used to manufacture tubular bags, the four edges of which are welded. These tubular bags are relatively stable. The otherwise centrally extending longitudinal seam of the bag is located at an edge of the bag by an asymmetrical forming shoulder so that a separate longitudinal seam no longer exists. In another known tubular bagging machine, a centrally arranged longitudinal seam of the bag is created by means of a symmetrical forming shoulder. The edges of the bag are separately welded so that a bag has five longitudinally extending welding seams.

Whereas a bag with merely four vertically extending welding seams does not have a longitudinal seam, which interferes with the printing on the bag, a common, symmetrical forming shoulder can be used for the manufacture of a bag with a center longitudinal seam.

The known bags have the disadvantage that they have a relatively square shape with an approximately center point of gravity. They are thus not suited for packaging of certain products, for which a relatively high bag with a relatively low center of gravity is desired.

The basic purpose of the invention is to provide a vertical tubular bagging machine of the above-described type and a bag manufactured therewith so that bags with vertical, welded edges are created in a manner which has, for the purpose of a good stability, a relatively low center of gravity.

SUMMARY OF THE INVENTION

The vertical tubular bagging machine of the invention has on the one side of the fill pipe only one edge-welding device to create a top seam and on the opposite side of the fill pipe two edge-welding devices to create two bottom seams of a bag. The bag manufactured by means of such a tubular bagging machine has as a special feature this top seam and these bottom seams.

The invention has the advantage that a bag stabilized in vertical direction is achieved, the center of gravity of which is relatively low. The cross-welding device produces two welding seams per bag which extend in vertical direction and stabilize the bag in this direction. The low center of gravity is achieved by providing two bottom seams and only one top seam. The two bottom seams result, because of their distance from one another, in a relatively wide bottom of the bag, whereas the one top seam enables the bag to converge pointed at the top. The bag on the vertical tubular bagging machine is filled through an opening which, after the bag has been filled, is closed off by a vertically aligned welding seam.

When a device for changing the distance between the edge-welding devices and/or a device for changing the distance between the expanding elements is provided on the two edge-welding devices on the opposite side, then this accomplishes several advantages. A change of the distance between the edge-welding devices results in a change of the distance between the bottom seams. Thus it is easily possible to change the thickness of the bag in the area of its bottom seams. A change of the distance between the edge-welding devices serves to adjust to a different fill pipe having a different cross section in order to manufacture bags with different widths. When both the distance between the expanding elements and also the distance between the edge-welding devices are changed, it is easily possible to adjust the tubular bagging machine to the production of bags with a changed width and bottom-side thickness.

When the forming shoulder is an asymmetrical forming shoulder with two differently long collar front parts, it is possible to place a vertically extending seam for closing of the foil tube parallel to its transport device into the top seam or one of the bottom seams of the bag. Such a seam has the advantage that a side surface of the bag, and there in particular the printing, is not hindered by a further seam.

An air intake on an expanding element for the purpose of sucking in the foil has the advantage that a foil deflection occurs in this manner in order to create a foil edge. The deflected foil is guided over the expanding element. The edge welding occurs in the area of the expanding element.

The tubular bagging machine can be operated continuously or in cycles. The foil is removed accordingly. Sealing bands, which rotate to weld the edges, and a rotating system of cross-jaws are suited for a continuous operation. Hot-sealing jaws, which are cyclically operated, can be used in a cycled operation.

When a device for mounting of an edge reinforcement, in particular a foil or metal strip, is provided on the flat strip of foil, and when this edge reinforcement is intended for entry into an edge to be welded, then it is possible to reinforce one edge of the bag in order to increase in this manner the stability of the bag. The two edges at the bottom of the bag are reinforced when one device is provided for both edge-welding devices on the opposite side. A stable bottom secures in a relatively good manner the outer shape of the bag.

BRIEF DESCRIPTION OF THE DRAWINGS

The invention will be described hereinafter in connection with the figures illustrating one exemplary embodiment, of which figures.

DETAILED DESCRIPTION

Figure 1:
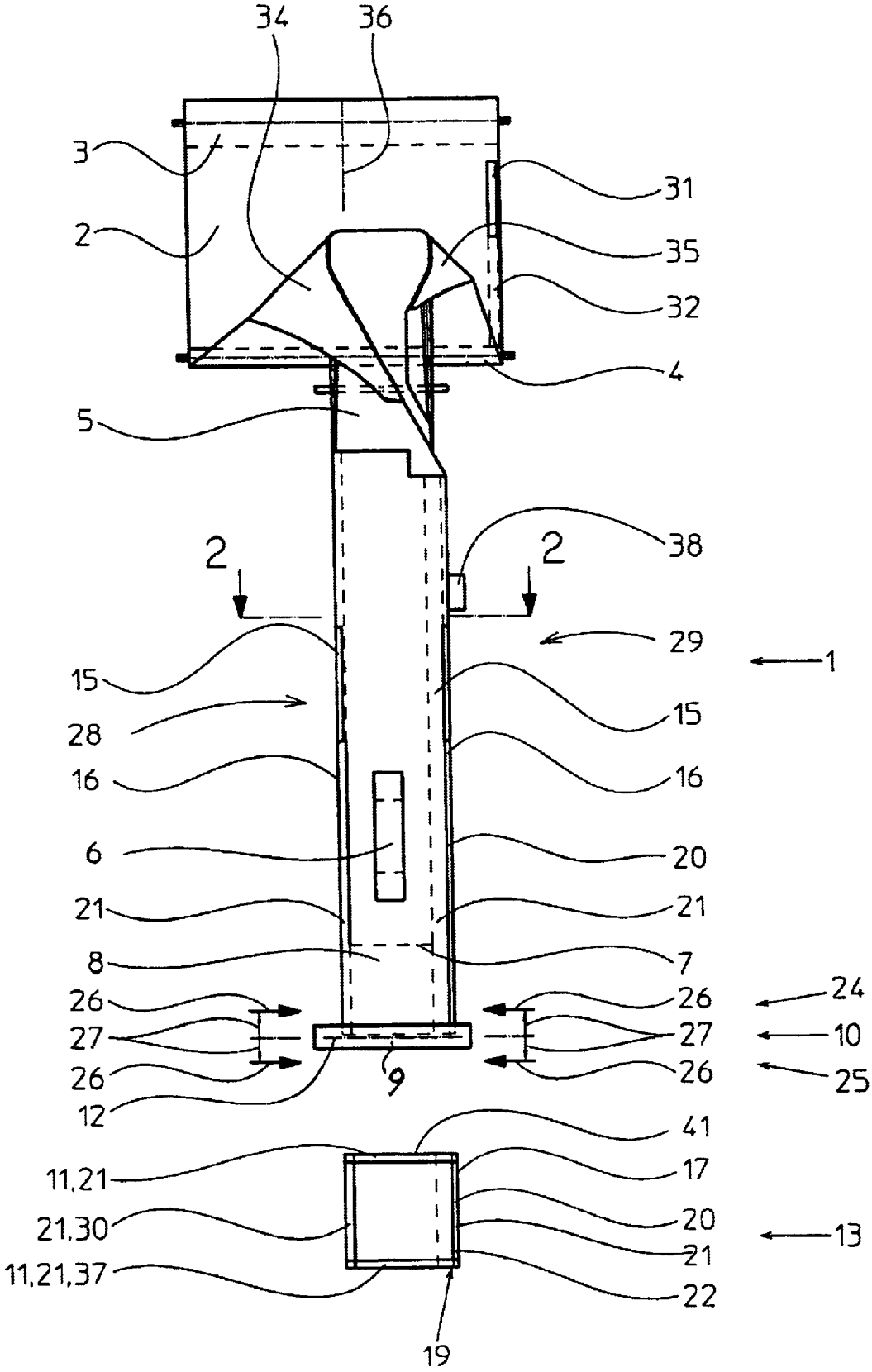
FIG. 1 is a side view of a tubular bagging machine for producing a tubular bag with edges which are reinforced at the bottom side, comprising an asymmetrical forming shoulder for reshaping a flat strip of foil into a foil tube, a tapered fill pipe, flat expanding elements, closed, rotating jaws of a cross-welding device, and comprising edge-welding devices directed against the deflected tube edges.

A flat strip of foil 2 is unwound from a storage roller in a vertical tubular bagging machine 1 and is fed over a guide roller 4 to a forming shoulder 5, which is shifted to the right asymmetrically with respect to the center 36 of the strip of foil 2 (FIG. 1). The collar front parts 34, 35 of the forming shoulder 5 have different lengths. A foil-removing means or driving device 6 is used to forward or move the strip of foil 2 from the forming shoulder 5 to a fill pipe 7. The fill pipe 7 receives the strip of foil 2 which has been formed by the forming shoulder into a foil tube 8. Jaws 9 of a cross-welding device 10, which jaws can be moved toward one another, are used to create cross-seams 11 on the foil tube 8. One of the jaws 9 houses a separating device 12 to cut the foil tube 8 between each two cross-seams 11. The created bags 13 are filled through the fill pipe 7.

Figure 2:
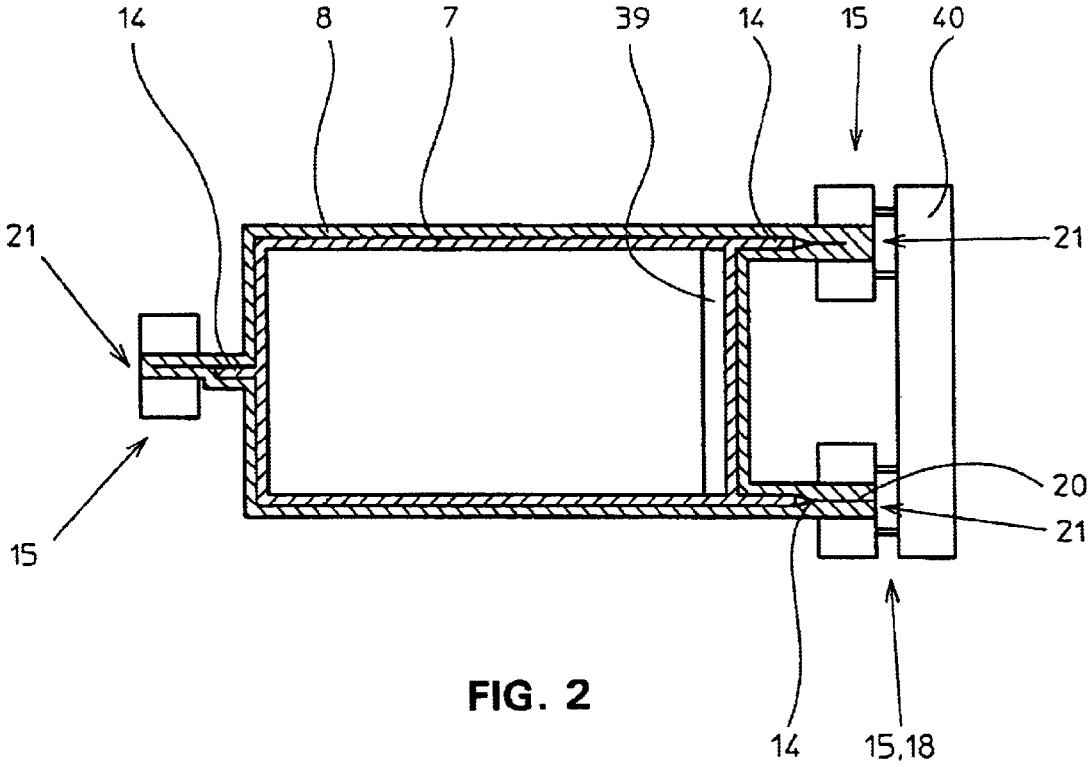
FIG. 2 is a crosssectional view taken along the line 2—2 of FIG. 1 of the fill pipe with three expanding elements, an edge-welding device per expanding element, wherein only one edge-welding device is provided on one side of the fill pipe and two edge-welding devices, which can be adjusted in their distance to one another, are provided on the opposite side.
Figure 3:
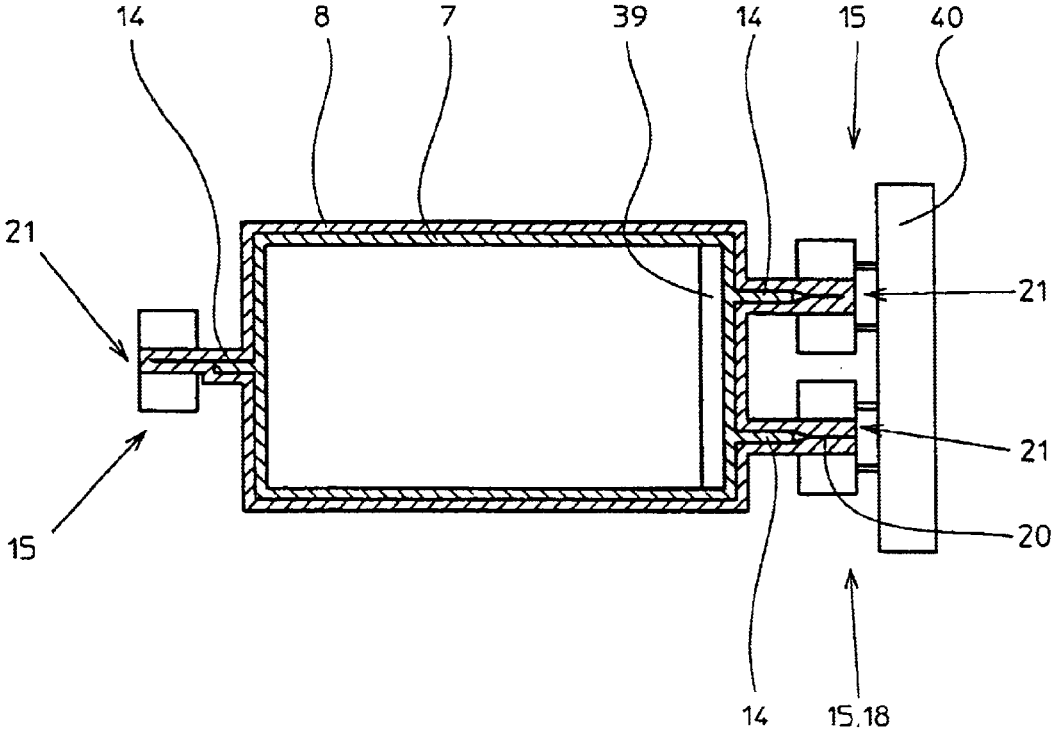
FIG. 3 is a cross-sectional illustration of the subject matter of FIG. 2, however, with a changed distance between the expanding elements and the edge-welding devices.

Three flat expanding elements 14, which project away from the fill pipe 7, are connected to the fill pipe 7 (FIGS. 2 and 3). An edge-welding device 15 per expanding element 14 is provided in the foil-transport direction following the expanding elements 14, namely below the expanding elements 14, each edge-welding device 15 being directed toward a tube edge 16 deflected by an expanding element 14.

The forming shoulder 5 shifts the superposed foil edges 17 to the right to the side of the foil tube 8. The edge-welding devices 15 are intended for a welding of the area 19 adjacent to the tube edge 16. One of the edgewelding devices 15 is used as a longitudinal welding device 18 and creates in addition a longitudinal seam 20, whereas the two other edge-welding devices 15 create only one welded edge or fold 21 on the foil tube 8. Each foil edge 17 projects like a fin 22 away from the foil tube 8.

The foil-removing means 6 is continuously operated. The longitudinal welding device 18 and the edge-welding devices 15 are continuously driven, rotating sealing bands. The edge-welding devices 15 each have a bracket 23.

Two pairs 24, 25 of side-fold producers 26 are provided on the cross-welding device 10. The two side-fold producers 26 of one pair 24, 25 can be moved toward one another and into the foil tube 8 lying between them in order to create side folds in the bag 13. One pair 24 is provided in foil-transport direction in front of and one pair 25 after the cross-welding device 10. The distance 27 of the one pair 24 from the cross-welding device 10 is, viewed in foil-transport direction, the same as the distance 27 of the other pair 25 from the cross-welding device 10.

Only one edge-welding device 15 for creating a top seam 30 is provided on one side 28 of the fill pipe 7. Two edge-welding devices 15 for creating two bottom seams 37 of the bag 13 are provided on the opposite side 29 of the fill pipe. A device 40 for changing the distance between the edge-welding devices 15 and a device 39 for changing the distance between the expanding elements are provided on the two edge-welding devices 15 on the opposite side 29. Flatter bags 13 are created with an adjustment of the devices 39, 40 toward a lesser distance.

An air intake 38 to suck in the foil is provided on each expanding element 14 on the opposite side 29. A device 31 to mount an edge reinforcement 32 is provided on the flat strip of foil 2. The edge reinforcement 32 is a strip of foil which is welded to the strip of foil 2 in order to form an edge 21 to be welded.

Figure 4:
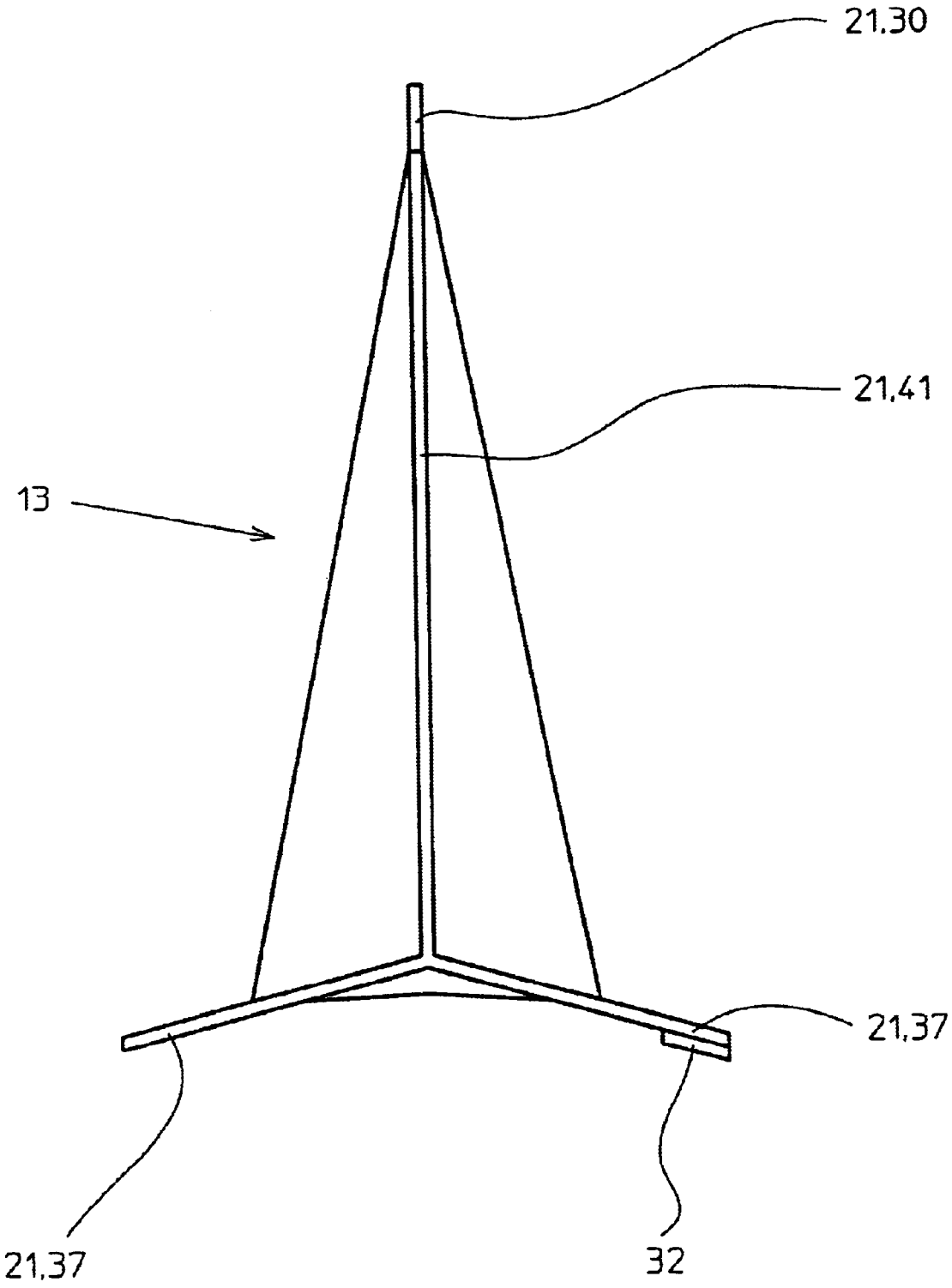
FIG. 4 is a side view of a bag which has been produced with the vertical tubular bagging machine of FIG. 1, and the top seam of which was welded by the edge-welding device on the one side of the fill pipe and the bottom seams of which were welded by the two edge-welding devices on the opposite side of the fill pipe.

The edge reinforcement 32 stabilizes a bottom seam 37 of a created bag 13 (FIG. 4). The top seam 30 of the bag 13 was welded by the edge-welding device 15 on the one side 28. The bottom seams 37 were welded by the two edge-welding devices 15 on the opposite side 29 of the fill pipe 7. The bag 13 is filled through one of its side edges 41, which was created by the cross-welding device 10.

List of Reference Numeral

1 Vertical tubular bagging machine
2 strip of foil
3 storage roller
4 guide roller
5 forming shoulder
6 foil-removing means
7 fill pipe
8 foil tube
9 jaw
10 cross-welding device
11 cross- seam
12 separating device
13 bag
14 expanding element
15 edge-welding device
16 tube edge
17 foil edge
18 longitudinal welding device
19 area
20 longitudinal seam
21 welded edge
22 fin
23 bracket
24,25 pair
26 side-fold producer
27 distance
28 side
29 opposite side
30 top seam
31 device for mounting
32 edge reinforcement
33 side fold
34,35 collar front par
36 center of trip of foil
37 bottom seam
38 air intake
39 device for changing the distance between the expanding elements
40 device for changing the distance between the edge-welding devices
41 side edge

What is claimed is:

1. A vertical tubular bagging machine comprising a flat strip of foil, a storage roller, guide rollers to guide the flat strip of foil to a forming shoulder, a foil moving device to facilitate transport of the strip of foil, a vertically aligned fill pipe to receive the strip of foil which has been reshaped into a foil tube, jaws of a cross-welding device to form cross-seams, a separating device to cut the foil tube, and expanding elements connected to the fill pipe and projecting away from the fill pipe, wherein edge-welding devices corresponding to the expanding elements are provided in a foil-transport direction arranged after the respective expanding elements, each of the edge-welding devices being directed against a tube edge deflected by a corresponding one of the expanding elements, wherein only one of the edge-welding devices is provided on one side of the fill pipe to form a top seam, and two other ones of the edge-welding devices are provided on the opposite side of the fill pipe to form two bottom seams of a bag, and wherein at least one of a device for changing the distance between the edge-welding devices and a device for changing the distance between the expanding elements is provided with the two edge-welding devices on the opposite side.

2. The tubular bagging machine according to claim 1, wherein the forming shoulder comprises an asymmetrical forming shoulder with two collar front parts of different lengths.

3. The tubular bagging machine according to claim 1, wherein the foil moving device comprises a continuously operated foil moving device, and wherein the edge-welding devices comprise continuously driven welding devices including rotating sealing bands.

4. The tubular bagging machine according to claim 1, including a device for mounting an edge reinforcement, the edge reinforcement comprising a second foil or a metal strip provided on the flat strip of foil for entry into one of the edge-welding devices as an edge to be welded.

5. A vertical tubular bagging machine comprising a flat strip of foil, a storage roller, guide rollers to guide the flat strip of foil to a forming shoulder, a foil moving device to facilitate transport of the strip of foil, a vertically aligned fill pipe to receive the strip of foil which has been reshaped into a foil tube, jaws of a crosswelding device to form cross-seams, a separating device to cut the foil tube, and expanding elements connected to the fill pipe and projecting away from the fill pipe, wherein edge-welding devices corresponding to the expanding elements are provided in a foil-transport direction arranged after the respective expanding elements, each of the edge-welding devices being directed against a tube edge deflected by a corresponding one of the expanding elements, wherein only one of the edge-welding devices is provided on one side of the fill pipe to form a top seam, and two other ones of the edgewelding devices are provided on the opposite side of the fill pipe to form two bottom seams of a bag, wherein an air intake to suck in the foil is provided on one of the expanding elements.

6. A vertical tubular bagging machine comprising a flat strip of foil, a storage roller, guide rollers to guide the flat strip of foil to a forming shoulder, a foil moving device to facilitate transport of the strip of foil, a vertically aligned fill pipe to receive the strip of foil which has been reshaped into a foil tube, jaws of a cross-welding device to form crossseams, a separating device to cut the foil tube, and expanding elements connected to the fill pipe and projecting away from the fill pipe, wherein edge-welding devices corresponding to the expanding elements are provided in a foiltransport direction arranged after the respective expanding elements, each of the edge-welding devices being directed against a tube edge deflected by a corresponding one of the expanding elements, wherein only one of the edge-welding devices is provided on one side of the fill pipe to form a top seam, and two other ones of the edge-welding devices are provided on the opposite side of the fill pipe to form two bottom seams of a bag, wherein at least one of a device for changing the distance between the edge-welding devices and a device for changing the distance between the expanding elements is provided with the two edge-welding devices on the opposite side, and a device for mounting an edge reinforcement on the flat strip of foil, wherein the edge reinforcement is provided for entry into at least one of the edge-welding devices on the opposite side.

7. A tubular bagging machine comprising:

a storage roller for supplying a strip of foil;

guide rollers to guide the strip of foil to a forming shoulder;

a forming device for forming the strip of foil into a foil tube;

a fill pipe for receiving the strip of foil shaped into the foil tube;

expanding elements secured to and projecting away from the fill pipe;

edge-welding devices corresponding to each of the expanding elements, said edge-welding devices being adjacent said expanding elements, one of the edgewelding devices provided on one side of the fill pipe for forming a top seam and other ones of the edge-welding devices provided on the opposite side of the fill pipe for forming bottom seams of a bag;

a device for changing at least one of a distance between the edge-welding devices and the distance between the expanding elements;

a cross-welding device for forming cross-seams, and a separating device for severing the foil tube to form the bag.

8. The tubular bagging machine according to claim 7, comprising the device for changing a distance between the edge-welding device and a second device for changing the distance between the expanding element.

* * * * *